US012274360B2

(12) United States Patent
Doherty et al.

(10) Patent No.: US 12,274,360 B2
(45) Date of Patent: Apr. 15, 2025

(54) SHELVING POST COUPLING SYSTEM

(71) Applicant: Armadillo Tough LLC, Boynton Beach, FL (US)

(72) Inventors: Robert Doherty, Boynton Beach, FL (US); Aaron Diamond, Boynton Beach, FL (US)

(73) Assignee: Armadillo Tough LLC, Boynton Beach, FL (US)

( * ) Notice: Subject to any disclaimer, the term of this patent is extended or adjusted under 35 U.S.C. 154(b) by 0 days.

(21) Appl. No.: 18/222,891

(22) Filed: Jul. 17, 2023

(65) Prior Publication Data

US 2025/0024942 A1 Jan. 23, 2025

(51) Int. Cl.
*A47B 87/02* (2006.01)

(52) U.S. Cl.
CPC ..... *A47B 87/0223* (2013.01)

(58) Field of Classification Search
CPC ... A47B 47/0083; A47B 57/54; A47B 57/545; A47B 87/0207; A47B 87/0215; A47B 87/0223; A47B 96/145; A47B 96/1458; A47B 96/1466; A47B 96/1475; A47B 2087/023; A47B 2087/0238; F16B 7/0406; F16B 7/0413; F16B 7/042; F16B 7/0426; F16B 12/28; F16B 12/32; F16B 12/34; F16B 12/38; F16B 12/40; F16B 12/42; F16B 12/50; F16B 2012/403; F16B 2012/406; F16B 2012/505; Y10T 403/55; Y10T 403/551; Y10T 403/555; Y10T 403/559
USPC ..... 211/186
See application file for complete search history.

(56) References Cited

U.S. PATENT DOCUMENTS 660,308 A * 10/1900 Pixley ..... F16B 7/0413 411/460
1,797,691 A * 3/1931 Merrill ..... E04G 7/301 403/292
3,004,784 A * 10/1961 Selby ..... E04G 7/20 411/398
4,645,276 A * 2/1987 Flavigny ..... A47B 96/1475 108/107
4,900,108 A * 2/1990 Tischer ..... A47B 47/0008 312/265.3
5,017,182 A * 5/1991 Mabie ..... F16G 11/08 411/902
5,127,762 A * 7/1992 Havlovitz ..... F16B 7/042 403/328
D693,668 S * 11/2013 Wojtowicz ..... D8/394
9,474,369 B1 * 10/2016 Tsai ..... A47B 87/02
(Continued)

*Primary Examiner* — Joshua E Rodden
(74) *Attorney, Agent, or Firm* — Akerman LLP; Ryan Harding

(57) ABSTRACT

A shelf post coupler may include an upper insert end and a lower insert end, each dimensioned to be received within an insert slot defined by shelving post ends to be joined. Insert holes extend through the upper insert end and the lower insert end for receiving fasteners to secure the coupler to shelving post ends. The upper and lower insert ends may each have a first side and a second side that extends from a midline along different planes. A spacer including a protruding lip may be located between the upper insert end and the lower insert end. At least one of the upper insert end and the lower insert end may include a riser and a wing. The wing may extend a greater distance from the midline than the riser.

10 Claims, 5 Drawing Sheets

(56) References Cited

U.S. PATENT DOCUMENTS

| | | | | |
|---|---|---|---|---|
| 10,626,905 | B1 * | 4/2020 | Chiu | A47B 57/545 |
| 11,083,289 | B2 * | 8/2021 | Nemeth et al. | A47B 87/0215 |
| D949,004 | S * | 4/2022 | Parab | D8/394 |
| 2006/0163438 | A1 * | 7/2006 | Wojotowicz | A47F 5/14 248/300 |
| 2009/0107942 | A1 * | 4/2009 | Liao | A47B 87/0223 211/183 |
| 2011/0272373 | A1 * | 11/2011 | Wojtowicz | A47B 96/1458 248/218.4 |
| 2013/0343810 | A1 * | 12/2013 | Summers | F16B 19/02 403/292 |
| 2019/0059588 | A1 * | 2/2019 | Liss | A47B 96/1408 |
| 2021/0341005 | A1 * | 11/2021 | Suzuki | A47B 47/0008 |

* cited by examiner

SHELVING POST COUPLING SYSTEM

TECHNICAL FIELD

The present description is directed to systems and components for coupling shelving posts to increase post height, shelf tiers, or otherwise stack shelving.

BACKGROUND

Rack Shelving typically includes one or more supported platforms or shelves upon which objects may be placed. These shelves are often referred to as tiers or levels. It is common for rack shelving to include shelf systems that allow a user to adjust the number and vertical spacing between shelves by providing multiple connection points for securing shelves along posts of a shelving unit. Increasing the number of shelves can be used to maximize available shelf area within the footprint of a shelving unit. This can be done by adding additional shelves within an available vertical space provided by the posts of the shelving unit for supporting shelves.

Increasing the height of the posts by coupling additional lengths of post may also be used to increase the available vertical space for supporting shelves. Similarly, shelving units may be stacked by coupling posts of one shelving unit to posts of another shelving unit. This may provide an ability to further adjust the number and vertical spacing between shelves of the stacked units. Thus, multiple modular shelving units may be stacked to provide a desired height and vertical space between shelves.

Rack Shelving is also shipped and sold for assembly by users. To reduce storage space and shipping costs, posts may be provided in short segments that users couple end-to-end to assemble longer posts for use.

What is needed are alternative devices and systems to couple shelving posts that are sturdy and simple to assemble.

SUMMARY

In one aspect, a shelf post coupler may include an upper insert end and a lower insert end, each dimensioned to be received within an insert slot defined by shelving post ends to be joined. Insert holes extend through the upper insert end and the lower insert end for receiving fasteners to secure the coupler to shelving post ends. Additionally, or alternatively, the upper insert may include fasteners comprising locking tabs for locking with post holes of shelving post ends. The upper and lower insert ends may each have a first side and a second side that extends from a midline along different planes. A spacer including a protruding lip may be located between the upper insert end and the lower insert end. At least one of the upper insert end, and the lower insert end, may include a riser and a wing. The wing may extend a greater distance from the midline than the riser.

In one example, the insert holes extend through the riser.

In one example, the spacer extends continuously around the coupler.

In one example, the riser is positioned a greater distance from the apposed insert end than the wing.

In one example, the wing includes at least a first wing and at least a second wing. One of the first side of the upper insert end or the first side of the lower insert end may include a respective first wing and one of the second side of the upper insert end or the second side of the lower inert end may include a second wing. In one configuration, the first wing and second wing are on the same insert end. In a further example, the riser may extend along both the first side and the second side of the at least one of the upper insert end and the lower insert end. In a further example, the riser may include an upper riser and a lower riser. The upper insert end may include the upper riser and the lower insert end includes the lower riser. Each of the upper insert end and the lower insert end may include the first wing and the second wing extending along the corresponding first side and second side of the insert end. The upper and lower risers may extend a greater distance from the spacer than the corresponding first wing, second wing, or both. The insert holes may include at least four holes including an insert hole through each of the first side and second side of both the upper riser and lower riser. In a further example, the spacer extends continuously around the coupler.

In another aspect, a shelf post coupling system includes a coupler comprising an upper insert end and a lower insert end. The system may further include a first shelf post end and a second shelf post end. Each shelf post end may include an insert slot for receiving one of the upper or lower insert ends of the coupler and a post hole for receiving a fastener to secure the coupler when received within the slot. The coupler may further include at least one insert hole extending though the upper insert end and at least one insert hole extending through the lower insert end. The insert holes may be positioned to align with one of the post holes when the respective insert end is received within the insert slot of one of the first or second shelf post ends. The upper and lower insert ends may each include a first side and a second side that extend from a midline along different planes. At least one of the upper insert end and the lower insert end may include a riser and a wing. The wing extends a greater distance from the midline than the riser.

In one example, the coupler further includes a spacer including a protruding lip positioned between the upper insert end and the lower insert end.

In one example, the riser is positioned a greater distance from the apposed insert end than the wing.

In one example, the wing includes multiple wings. One of the first side of the upper insert end, the first side of the lower insert end, or both may include a respective first wing and one of the second side of the upper insert end, the second side of the lower inert end, or both may include a respective the second wing. The riser may extend along both the first side and the second side of the at least one of the upper insert end and the lower insert end. The riser may include an upper riser and a lower riser. The upper insert end may include the upper riser and the lower insert end may include the lower riser. Each of the upper insert end and the lower insert end may include a respective first wing and a respective second wing. In some examples, the insert holes may include at least four holes including insert holes through each of the first side and second side of both the upper riser and lower riser. The post hole comprises at least four post holes corresponding to the at least four insert holes when received within the first and second insert slots. In one configuration, a spacer including a protruding lip positioned between the upper insert end and the lower insert end. The upper and lower risers may extend a greater distance from the spacer than the wing.

In one example, the insert slots are defined by outwardly positioned closed ends and include inwardly positions open ends.

In one example, the planes of the first side and the second side of each of the upper and lower insert ends are approximately perpendicular.

BRIEF DESCRIPTION OF THE DRAWINGS

Novel features of the present invention are set forth with particularity in the appended claims. However, the various embodiments described herein, both as to organization and manner of operation, may be best understood by reference to the following description, taken in conjunction with the accompanying drawings in which:

DESCRIPTION

The present description describes various embodiments of a shelf post end coupler and shelf post coupling system for coupling shelf posts. The coupler and system may find use in many common shelving applications. For example, the coupler and system may be utilized to conveniently extend shelf posts, whether for initial assembly or to increase vertical space for shelving thereafter. As another example, the coupler and system may be used to conveniently stack modular shelving units.

Various embodiments of a shelf post end coupler 10 and shelf post end coupling system 100 are described herein with respect to FIGS. 1A-4B wherein like numbers are used to identify like features.

Figure 1A:
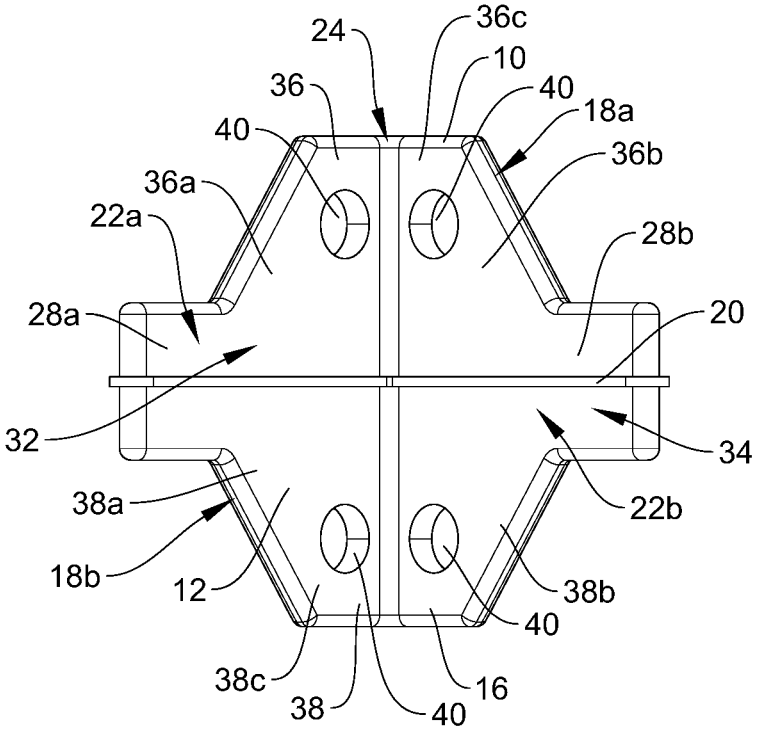
FIGS. 1A & 1B illustrate respective interior and exterior sides of a coupler configured to couple two shelf post ends according to various embodiments described herein.
Figure 1B:
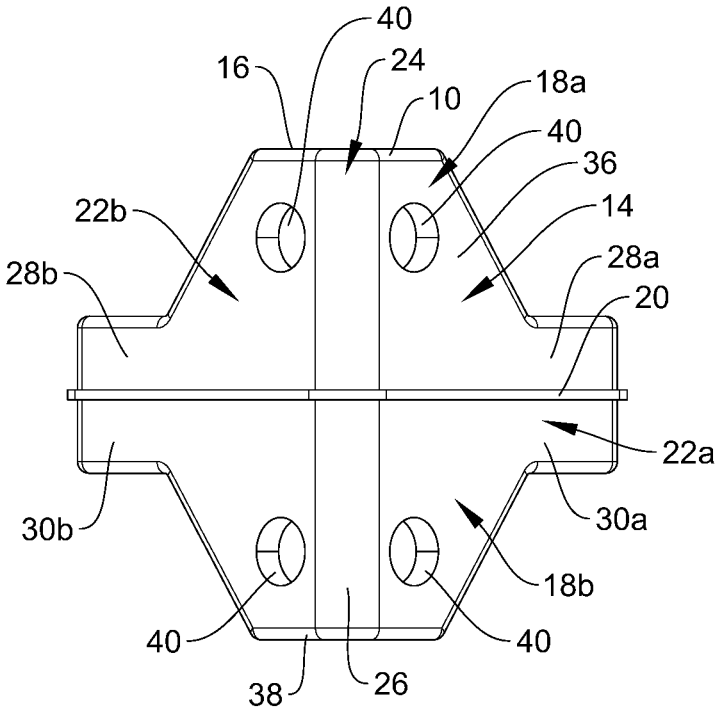

FIGS. 1A & 1B illustrate an interior side 12 and an exterior side 14 of a coupler 10 configured to couple two shelf post ends according to various embodiments. The coupler 10 includes a body 16 extending between an upper insert 18*a* and a lower insert 18*b*. The coupler 10 may be constructed of suitably rigid material to couple shelf ends, such metal, metallic, alloys, rigid plastics, or the like. The spacer 20 extends outwardly from body 16 between the upper insert 18*a* and the lower insert 18*b*. Spacer 20 may be dimensioned to have an outward extending length configured to position between shelf post ends to which it couples. In some embodiments, a spacer 20 may be optional. The spacer 20 may generally extend along a horizontal plane of the body 16. In the illustrated embodiment, spacer 20 comprises a flange that extends completely around a perimeter of body 16. In some embodiments, the spacer 20 may not extend completely around the body 16. For example, spacer 20 may comprise one or more tabs that extend around all or a portion of an interior side 12, exterior side 14, or combination thereof of the body 16 but not completely around the body 16 in a continuous protruding structure. The outward extending length of the spacer 20 may be sufficient to interface with the shelf post ends to which it couples to be flush or provide a protruding lip along the side of the coupled shelf posts.

The upper insert 18*a* and lower insert 18*b* portions of the body 16 each include a first side 22*a* and second side 22*b* that extend from a vertical midline 24. The first sides 22*a* and the second sides 22*b* are shown positioned approximately perpendicular to each other. The midline 24 is curved to provide a rounded edge 26 between the first sides 22*a* and the second sides 22*b*. However, in other embodiments, the midline 24 may comprise an unbroken intersection between the first sides 22*a* and the second sides 22*b* providing a thinly defined edge therebetween. The first sides 22*a* and the second sides 22*b* may be arranged in other orientations, such as those providing a cross-section corresponding to a shelf post cross-sections to which they couple. In one example, body 16 has a rounded profile such that a horizontal cross-section of body 16 is curved and the first sides 22*a* and second sides 22*b* curve toward each other. In some embodiments, body 16 may be separated along the midline 24 such that the first sides 22*a* of the upper insert 18*a* and lower insert 18*b* are separate from the second sides 22*b* of the upper insert 18*a* and the lower insert 18*b*.

Various thicknesses of upper insert 18*a* and lower insert 18*b* may be used. The thickness may preferably correspond to a thickness of insert slots of post ends into which they are to slot. In one embodiment, the inserts 18*a*, 18*b* may be dimensioned to press fit into insert slots.

The upper insert 18*a* and lower insert 18*b* may each include a first wing 28*a*, 30*a* and a second wing 28*b*, 30*b*. The first wing 28*a* and the second wind 28*b* of the upper insert 18*a* extend laterally along a lower portion 32 of the upper insert 18*a* along the first side 22*a* and the second side 22*b* to the midline 24. The first wing 30*a* and the second wing 30*b* of the lower insert 18*b* extend laterally along an upper portion 34 of the lower insert 18*b* along the first side 22*a* and the second side 22*b* of the lower insert 18*b* to the midline 24.

The upper insert 18*a* and the lower insert 18*b* each include a riser 36, 38 positioned between and extending vertically beyond the respective first wing 28*a*, 30*a* and second wing 28*b*, 30*b*. The risers 36, 38 extend along the first side 22*a* and second side 22*b* of the upper insert 18*a* and lower insert 18*b* along the midline 24.

While the illustrated body 16 includes wings 28*a*, 28*b*, 30*a*, 30*b* and risers 36, 38, in some embodiments the upper insert 18*a*, lower insert 18*b*, or both may have profiles defining other shapes. For example, the body 16, upper insert 18*a*, lower insert 18*b*, the sides 22*a*, 22*b* thereof, or combination thereof may comprise any suitable geometric or non-geometric shape, such as oval, triangular, rectangular, pentagonal, hexagonal, or free form. As described in more detail below, the profile shape of the body 16 along the insert 18*a*, 18*b* portions may be selected to optimize an area of the upper insert 18*a* and lower insert 18*b* inserted within insert slots of coupled shelf post ends along a desired vertical length of insert. For example, wings 28*a*, 28*b*, 30*a*, 30*b* and one or more outer portions 36*a*, 36*b*, 38*a*, 38*b* of risers 36, 38 may be dimensioned to insert within insert slots while one or more inner portions 36*c*, 38*c* of risers 36, 38 adjacent to the midline 24 position outside insert slots.

The upper insert 18*a* and lower insert 18*b* each includes one or more insert hole 40 dimensioned to receive a fastener. The insert hole 40 are positioned to correspond to post holes formed in post ends when the respective upper insert 18*a* or lower insert 18*b* is inserted within the post end to together receive a fastener to fix the post end to the coupler 10. In the illustrated embodiment, an insert hole 40 is provided on the first side 22*a* and second side 22*b* of each of the upper insert 18*a* and lower insert 18*b*. The insert holes 40 are positioned along inner portions 36*c*, 38*c* of the riser 36, 38 portions on either side of the midline 24.

FIGS. 2A-2E illustrate use of coupler 10 in a shelf post coupling system 100 according to various embodiments described herein.

Figure 2A:
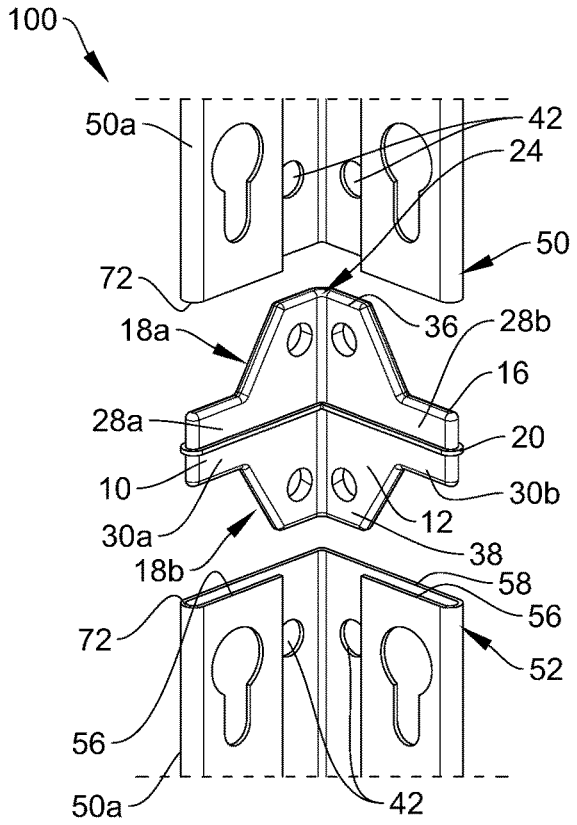
FIG. 2A illustrates a shelf post coupling system wherein a coupler is positioned between a first end and a second post end according to various embodiments described herein.

In FIG. 2A, coupler 10 is positioned between a first post end 50 and a second post end 52 of two posts 50. The upper insert 18*a* is aligned with an insert slot 54 in the first post end 50 and the lower insert 18*b* is aligned with an insert slot 56 in the second post end 52. The insert slots 54, 56 are formed between an exterior side and an interior side of the post ends. The insert slots 54, 56 are closed along a side that joins the exterior side and interior side of the post ends. Post holes 42 are provided through the exterior sides of post ends. As shown, a post hole 42 is provided on each of a first side and a second side of the exterior sides.

Figure 2B:
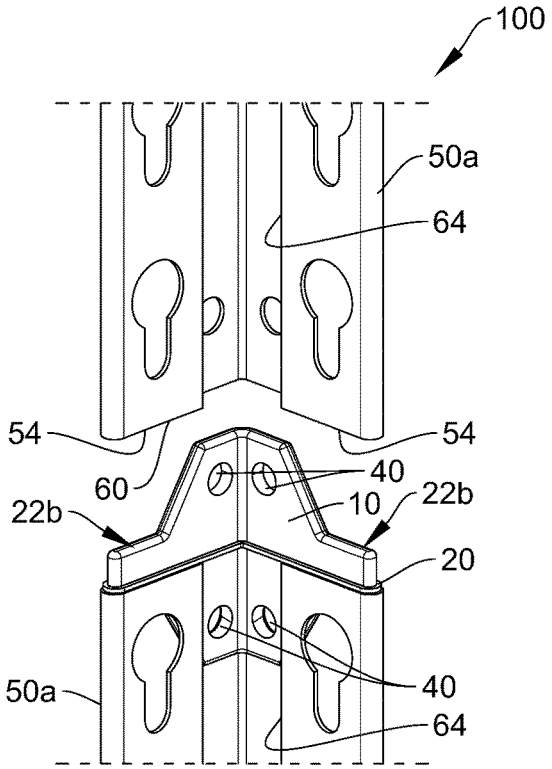
FIG. 2B illustrates a shelf post coupling system wherein a lower insert of a coupler is positioned within an insert slot of a second post end according to various embodiments described herein.
Figure 2C:
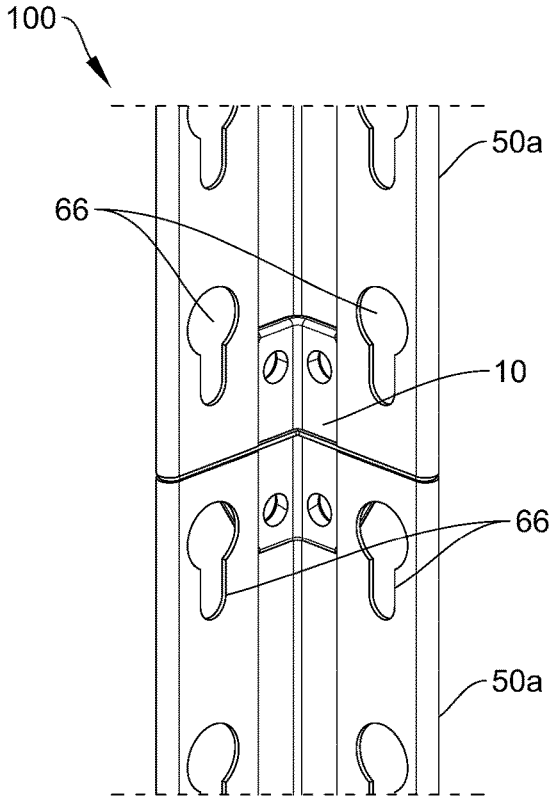
FIG. 2C illustrates a shelf post coupling system wherein a lower insert of a coupler is positioned within an insert slot of a second post end and an upper insert of the coupler is positioned within an insert slot of a first post end according to various embodiments described herein.

At least a portion of the upper insert 18*a* and lower insert 18*b* are configured to insert within the respective insert slots 54, 56. In FIG. 2B, the lower insert 18*b* of coupler 10 has been inserted within the insert slot 56 of the second post end 52. The wings 30*a*, 30*b* and outer portions 38*a*, 38*b* of the riser 38 position with the insert slot 56. The insert holes 40 align with the post holes 42, which, in this configuration, are positioned inwardly of the insert slot 56. A rim 58 of the second post end 52 engages against the spacer 20, conveniently preventing the coupler 10 from extending further within the insert slot 56 of the second post end 52. In FIG. 2C, the upper insert 18*a* of the coupler 10 has been inserted within the insert slot 54 of the first post end 50. The wings 28*a*, 28*b* and outer portions 36*a*, 36*b* of the riser 36 are positioned with insert slot 54. The insert holes 40 align with the post holes 42, which, in this configuration, are positioned inwardly of the insert slot 54. A rim 60 of the first post end 50 engages against the spacer 20, conveniently preventing the coupler 10 from extending further within the insert slot 54 of the first post end 50. It is to be appreciated that the insert slots 54, 56 may additionally or alternatively include tabs or closed ends configured to engage the upper insert 18*a* or lower insert 18*b* to limit the extent of insertion. In some configurations, a spacer 20 or tab is not provided, and the extent of insertion may be controlled by insertion of a fastener, such as the fastener arrangement described below and elsewhere herein.

Figure 2D:
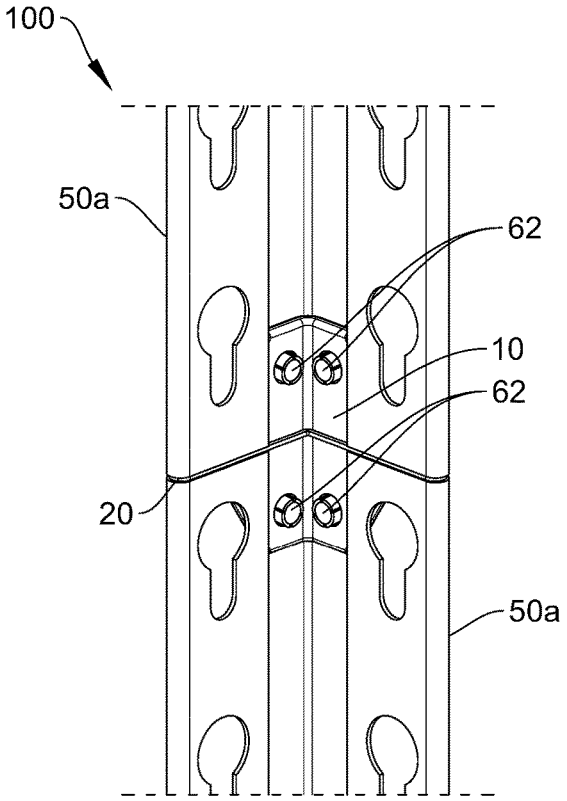
FIG. 2D illustrates an interior side of a shelf post coupling system coupling showing two post ends coupled by a coupler fastened thereto according to various embodiments described herein.
Figure 2E:
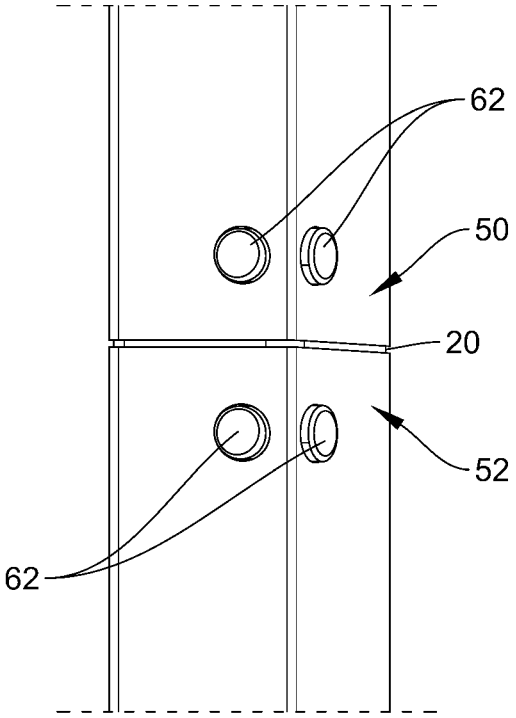
FIG. 2E illustrates an exterior side of a shelf post coupling system coupling showing two post ends coupled by a coupler fastened thereto according to various embodiments described herein.

In FIGS. 2D & 2E, fasteners 62 have been inserted through the aligned insert hole 40 and post holes 42 to fix the upper insert 18*a* and lower insert 18*b* to the first post end 50 and second post end 52 and within the insert slots 54, 56. Various fasteners 62 may be used, such as those described herein. In one embodiment, the fasteners 62 may comprise bolts, screws, or rivets. Fasteners 62 may be configured to be insertable by hand, without the assistance of tools. Fasteners 62 may be press fits. Fasteners 62 may be configured to expand within or otherwise be compressed against an insert hole 40 to secure therein. Fasteners 62 may be configured to compress or fold inwardly when passed through the insert hole 40 and to expand or otherwise position a structure beyond the insert hole 40 that extends beyond the outer diameter of the insert hole 40 to prevent the fastener 62 from being withdrawn from the insert hole 40. In one embodiment, fasteners 62 include slotted pins, bolts, clevis pin, or the like and a locking pin. Fasteners 62 may be formed from various materials such as metals, alloys, plastics, or other suitable materials. In some embodiments, the insert holes 40 comprise openings, such as a slot, to receive fasteners comprising locking tabs or locking tabs to lock with openings formed in post ends 50, 52. Locking tabs may comprise biased members that bend or otherwise compress for positioning into an adjacent opening where the tab may release within the opening to lock therein. As shown, fasteners 62 similar to those described with respect to FIGS. 3A & 3B may be inserted through the aligned insert hole 40 and post holes 42 to fix the upper insert 18*a* and lower insert 18*b* to the first post end 50 and second post end 52 and within the insert slots 54, 56.

In the illustrated embodiment, the interior side 64 of the first post end 50 and second post end 52 include tab slots 66 for receiving shelf tabs 68 (see, e.g., FIGS. 4A & 4B) along their length. In some embodiments, post ends 50, 52 do not include tab slots 66 or tab slots 66 that position within a plane horizontal to a portion of the upper insert 18*a* or lower insert 18*b* when inserted within the insert slot 54, 56. The upper insert 18*a* and lower insert 18*b* are dimensioned to not block the tab slots 66 to allow shelf tabs 68 to be received within the tab slots 66 and into the insert slots 54, 56 to lock in a shelf 70 (see, e.g., FIGS. 4A & 4B). Thus, the upper insert 18*a* or lower insert 18*b* may include an opening or lack of insert material configured to position within the insert slot 54, 56 in a manner that prevents shelf tabs 68 or other shelf coupling members from coupling to the post ends 50, 52. As shown, the wings 28*a*, 28*b*, 30*a*, 30*b* extend laterally within the insert slots 54, 56 to closed ends 72 and the risers 36, 38 extend vertically between laterally adjacent insert slots 54, 56. Outer portions 36*a*, 36*b*, 38*a*, 38*b* of the risers 36, 38 also position within the insert slots 54, 56; however, in some embodiments, one or both risers 36, 38 do not position with the insert slots 54, 56.

Figure 3A:
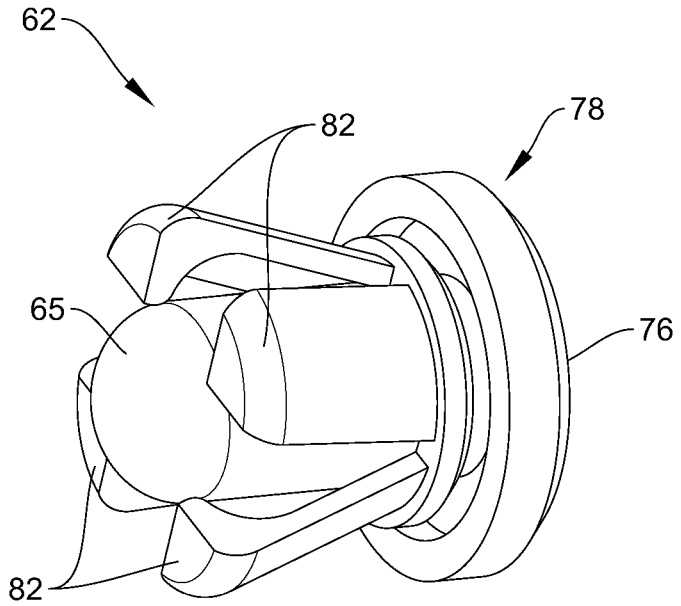
FIGS. 3A & 3B illustrate views of a fastener of a shelf post coupling system according to various embodiments described herein.
Figure 3B:
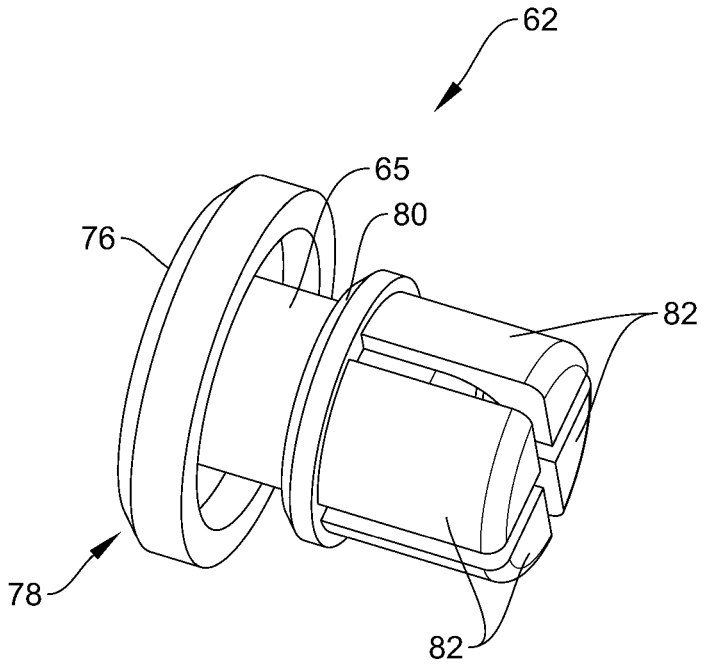

FIGS. 3A & 3B illustrate a fastener 62 according to various embodiments. The fastener 62 may be of the snap rivet type having a head 76 and a shaft 78 extending from the head 76. A ring 80 is slidably positioned around the shaft 78. A plurality of distally extending tabs 82 extend from the ring 80. The proximal portion of the interior sides of the tabs 82 may together define an orifice approximately corresponding to the profile of the shaft 65 such that the shaft 65 may position within the orifice. In operation, the tabs 82 and shaft 65 may be pressed through both the post hole 42 and insert hole 40 until an underside of the ring 80 engages the exterior side of the post 50*a* adjacent to the post hole 42. The tabs 82 may be bendably resilient such that distal extension of the shaft 65 through the ring 80, between the tabs 82, bends the tabs 82 outwardly as the ends of the tabs 82 are pressed against and position upon the outer surface of the end the shaft 65 as the end of the shaft 65 translates beyond the orifice. The outward bend of the tabs 82 press the tabs against the interior walls of at least the insert hole 42 and/or the distal ends of the tabs 82 position outwardly from and beyond the insert hole 40. In one example, a recess is formed in an underside of the head 76 that is complementary to the ring 80 such that when the fastener 62 is completely inserted and pressed in place, the ring 80 is received within the recess to provide a masked fitment wherein only the head 76 is exposed along the exterior of the side of the post. The fastener 62 may be formed from various materials such as metals, alloys, plastics, or other suitable materials.

Figure 4A:
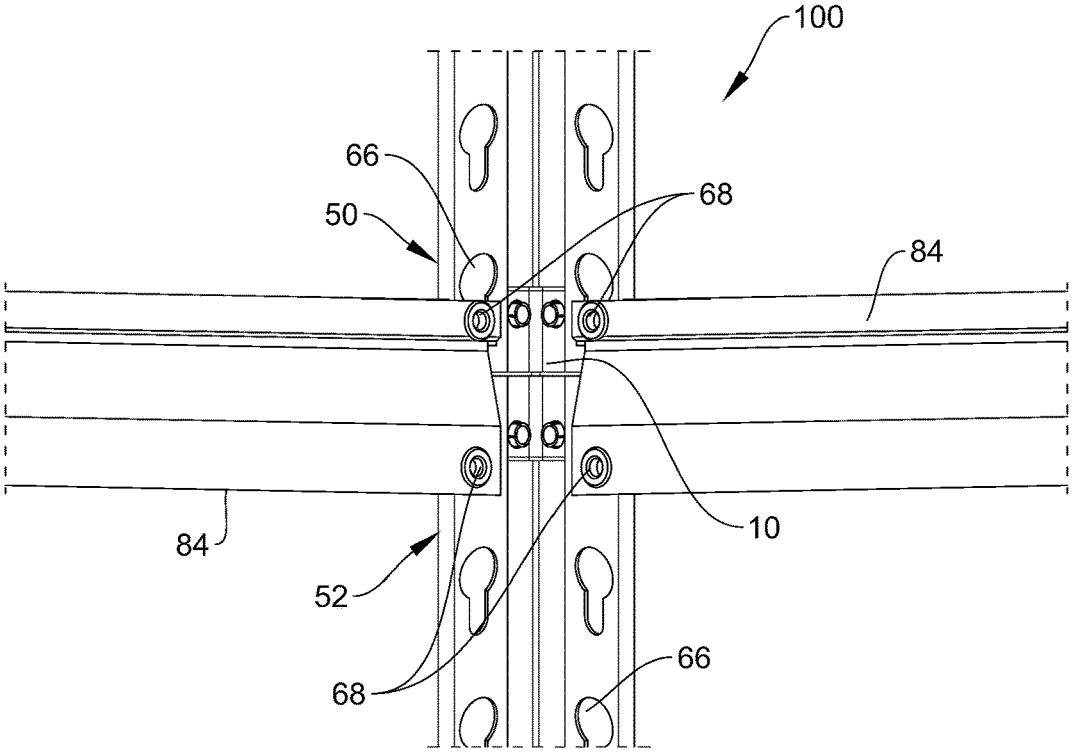
FIGS. 4A & 4B illustrate an embodiment of wherein a shelf post coupler or shelf post coupling system including the coupler is configured for use with a shelf that spans the coupled post ends.
Figure 4B:
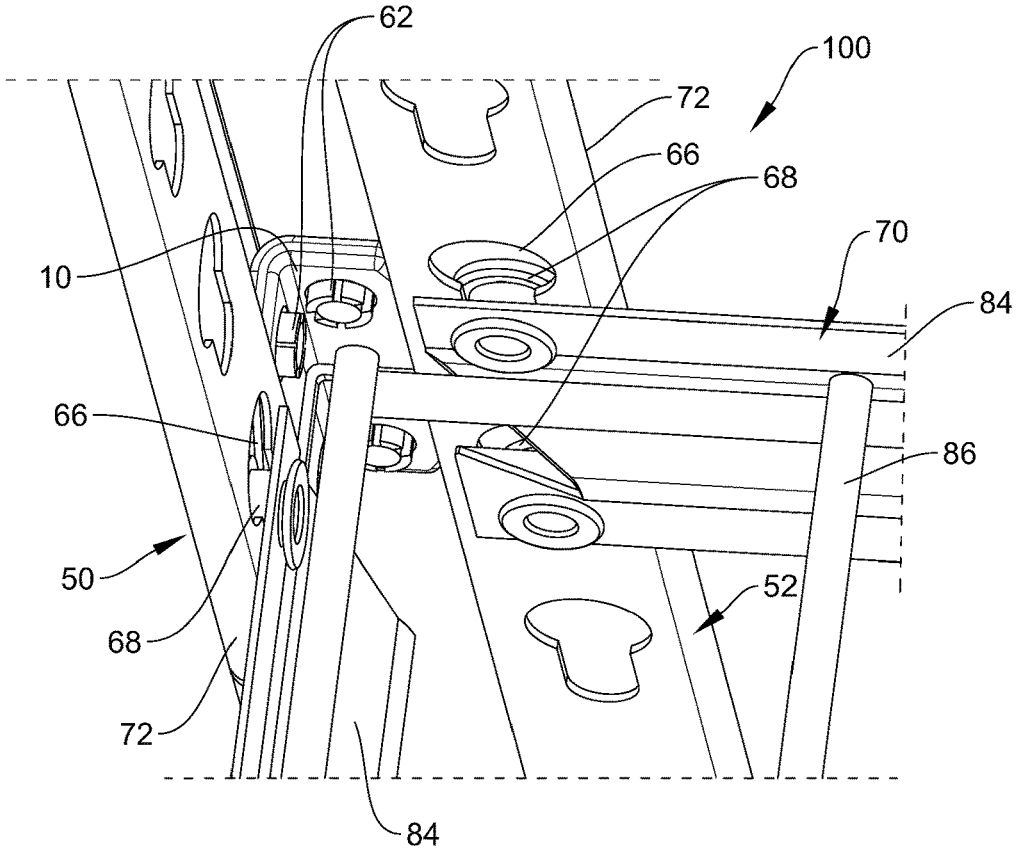

As described above, one or both sides 22*a*, 22*b* of the upper insert 18*a*, lower insert 18*b*, or both may be dimensioned to allow a shelf tab 68 to be received within tab slots 66 of coupled post ends 50, 52. For instance, when post ends 50, 52 include tab slots 66 that position over a portion of insert slots 54, 56, the upper insert 18*a*, lower insert 18*b*, or both may be configured to not block the tab slots 66 to allow shelf tabs 68 to be received within the tab slots 66 and into the insert slots 54, 56 to lock in a shelf 70. In some embodiments, the upper insert 18*a*, lower insert 18*b*, or both may have cutoff portions that may be selectively removed if desired. For example, a perforated or weakened connection may be provided to allow a user to snap or break off a portion of the upper insert 18*a*, lower insert 18*b*, or both to provide access within the insert slot 54, 56 for a tab slot 66 to be secured therein. FIGS. 4A & 4B illustrate an embodiment wherein a shelf post coupler 10 or shelf post stacking system 100 including the coupler 10 is configured for use with a shelf 70 that spans the coupled post ends 50, 52. The shelf 70 may include support rails 84 for supporting a shelf panel 86, a shelf panel 86 with integrated shelf tabs 68, or otherwise. The coupler 10 couples the post ends 50, 52 as described above. A support rail 84 having two spaced apart shelf tabs 68 may be secured to the posts by inserting the shelf tabs 68 into the openings of corresponding tab slots 66 and sliding to the restricted end of the tab slots 66. A second support rail 84 may be similarly secured along the adjacent set of tab slots 66. The opposite ends of the rails (not shown) may be similarly secured to adjacent coupled post ends. Additional rails (not shown) may similarly be secured to coupled post ends to provide a support perimeter or ledge for a shelf panel 86. In some embodiments, a shelf 70 does not span the coupled post ends 50, 52 or may span the coupled post ends 50, 52 and secure at only one of the coupled post ends 50, 52.

Those having skill in the art will appreciate upon reading the present disclosure that the inventive features described herein may be applied in many configurations without departing from the present disclosure. For example, in some embodiments, in addition to or alternatively to fastening the coupler 10 to just the exterior side of the post end 50, 52, post holes 42 may be provided through both the exterior side and the interior side 72 of the post end 50, 52 such that a fastener 62 may be inserted therethrough with the insert 18*a*, 18*b* positioned therebetween. In one embodiment, the insert slot defining portion of the interior side 64 of a post end 50, 52 is connected between closed ends 72 to envelope the insert 18*a*, 18*b*. For example, the insert slot 54, 56 may cover a horizontal perimeter of both the interior and exterior sides 12, 14 of the insert 18*a*, 18*b*. The insert slot 54, 56 may cover the interior side 12 along the inner portion 36*c*, 38*c* of the riser 36, 38. The insert slot 54, 56 may cover the interior side 12 along the midline 24. In the above example, post holes 42 may be provided through both the exterior side and the interior side 72 of the post end 50, 52 to align with insert holes 42 therebetween when the coupler 10 is inserted.

While embodiments of a single coupler have been illustrated and described above, it is to be appreciated that multiple couplers may be used to couple shelf posts. For example, for each shelf post to be coupled, a coupler may be provided and utilized as described herein to couple the shelf posts and securely stack shelving. The dimensions of the upper insert and lower insert are not limited to those shown in the drawings. For example, while the inserts or risers thereof in the illustrated embodiments are shown to extend to a height corresponding to a first tab slot, risers may not extend to a tab slot or may extend to or beyond multiple tab slots. As the coupler may be utilized with numerous configurations of post ends, tab slots may be located well beyond the upper extent of the inserts or risers thereof. Additional or fewer insert holes may be used. For example, additional insert hole may be provided adjacent to the midline along the first side of the upper insert, second side of the upper insert, first side of the lower insert, second side of the lower insert, or combination thereof. In this or another example, one or more insert holes may be provided along the upper insert, lower insert, or both configured to be positioned within the insert slot. The insert slots may be positioned to align with corresponding post holes, which may be provided along the exterior side, interior side, or both of the post end. It is also to be appreciated that a shelf post coupling system described herein is not limited to end posts that couple to shelves via the illustrated tabs slotted into tab slots. Other slotted tab configurations as well as other shelf attachment systems may be used, including bolts or pins.

This disclosure describes various elements, features, aspects, and advantages of various embodiments of a shelf post end coupler and shelf post coupling system for coupling shelf posts and methods of use. It is to be understood that certain descriptions of the various embodiments have been simplified to illustrate only those elements, features and aspects that are relevant to a clearer understanding of the disclosed embodiments, while eliminating, for purposes of brevity or clarity, other elements, features and aspects.

It is to be understood that while this description may use directional or relative positional language, the coupler and other system components may be used in multiple orientations, and such directional or relative positional language has been used to assist the reader in understanding the features and operations of the invention described herein and is not intended to be limiting.

Any references to "various embodiments," "certain embodiments," "some embodiments," "one embodiment," "an embodiment," or their "example," "configuration, or "instance" counterparts generally means that a particular element, feature and/or aspect described is included in at least one embodiment, but may not refer to the same embodiment. Furthermore, the phrases "in one such embodiment" or "in certain such embodiments," while generally referring to and elaborating upon a preceding embodiment, are not intended to suggest that the elements, features, and aspects of the embodiment introduced by the phrase are limited to the preceding embodiment; rather, the phrase is provided to assist the reader in understanding the various elements, features, and aspects disclosed herein and it is to be understood that those having ordinary skill in the art will recognize that such elements, features, and aspects presented in the introduced embodiment may be applied in combination with other various combinations and sub-combinations of the elements, features, and aspects presented in the disclosed embodiments. The grammatical articles "one", "a", "an", and "the", as used in this specification, are intended to include "at least one" or "one or more", unless otherwise indicated. Thus, the articles are used in this specification to refer to one or more than one (i.e., to "at least one") of the grammatical objects of the article. By way of example, "a component" means one or more components, and thus, possibly, more than one component is contemplated and may be employed or used in an implementation of the described embodiments. Further, the use of a singular noun includes the plural, and the use of a plural noun includes the singular, unless the context of the usage requires otherwise. The grammatical conjunctions "and" and "or" are used herein according to accepted usage. By way of example, "x and y" refers to "x" and "y". On the other hand, "x or y" generally refers to "x", "y", or both "x" and "y", and may be considered to be generally synonymous with "and/or," whereas "either x or y" refers to exclusivity.

It is to be appreciated that persons having ordinary skill in the art, upon considering the descriptions herein, will recognize that various combinations or sub-combinations of the various embodiments and other elements, features, and aspects may be desirable in particular implementations or applications. However, because such other elements, features, and aspects may be readily ascertained by persons having ordinary skill in the art upon considering the description herein and are not necessary for a complete understanding of the disclosed embodiments, a description of such elements, features, and aspects may not be provided. As such, it is to be understood that the description set forth herein is merely exemplary and illustrative of the disclosed embodiments and is not intended to limit the scope of the invention as defined solely by the claims.

What is claimed is:

1. A shelf post coupling system, the system comprising:

a coupler comprising an upper insert end, a lower insert end, at least one insert hole extending though the upper insert end, and at least one insert hole extending through the lower insert end, wherein the upper and lower insert ends each have a first side and a second side that extend along different planes from a vertically extending midline, and wherein at least one of the upper insert end and the lower insert end includes a riser and at least one wing, the at least one wing extending a greater lateral distance from the midline than the riser; and a first shelf post and a second shelf post, each having a shelf post end that includes a first side laterally positioned relative to a second side, the first and second shelf post sides of each shelf post end having at least one tab slot for receiving a shelf tab and each shelf post end comprising an insert slot for receiving one of the upper or lower insert ends of the coupler and at least one post hole for receiving a fastener to secure the coupler when received within the slot, wherein the tab slots are laterally offset from the post holes, and wherein the at least one insert hole of each of the upper and lower insert ends is positioned to align with one of the post holes when the respective insert end is received within the insert slot of one of the first or second shelf post ends.

2. The system of claim 1, wherein the coupler further comprises a spacer including a protruding lip positioned between the upper insert end and the lower insert end.

3. The system of claim 1, wherein the riser is positioned a greater vertical distance from the opposed insert end than the at least one wing.

4. The system of claim 1, wherein one of the first side of the upper insert end or the first side of the lower insert end includes at least a first wing of the at least one wing and one of the second side of the upper insert end or the second side of the lower insert end includes at least a second wing of the at least one wing.

5. The system of claim 4, wherein the riser extends along both the first side and the second side of the at least one of the upper insert end and the lower insert end.

6. The system of claim 1, wherein the riser and the at least one wing comprises an upper riser, a first upper wing, and a second upper wing, wherein the upper riser and the first upper wing extend along the first side of the upper insert end and the second upper wing extends along the second side of the upper insert end, wherein the lower insert end further comprises a lower riser, a first lower wing, and a second lower wing, wherein the lower riser and a first lower wing extend along the first side of the lower insert end, and the second lower wing extends along the second side of the upper insert, and wherein the first and second lower wings extend a greater lateral distance from the midline than the lower riser.

7. The system of claim 6, wherein the insert holes comprise at least four holes including insert holes through each of the first side and second side of both the upper riser and lower riser, and wherein the at least one post hole comprises at least four post holes corresponding to the at least four insert holes when received within the first and second insert slots.

8. The system of claim 7, wherein the coupler further comprises a spacer including a protruding lip positioned between the upper insert end and the lower insert end, and wherein the upper and lower risers extend a greater vertical distance from the spacer than the respective first and second upper and lower wings.

9. The system of claim 1, wherein the insert slots are defined by outwardly positioned closed ends and include inwardly positions open ends.

10. The system of claim 1, wherein the planes of the first side and the second side of each of the upper and lower insert ends are approximately perpendicular.

* * * * *